US005358578A

United States Patent [19]

Tischhauser

[11] Patent Number: 5,358,578

[45] Date of Patent: Oct. 25, 1994

[54] PROCESS FOR THE PRODUCTION OF PRESTRESSED STEELS AND ITS NAMED PRODUCT

[76] Inventor: Max W. Tischhauser, Weinmanngasse 26, Kuesnacht, Switzerland

[21] Appl. No.: 4,486

[22] Filed: Jan. 12, 1993

Related U.S. Application Data

[63] Continuation of Ser. No. 809,228, Dec. 17, 1991, abandoned, which is a continuation of Ser. No. 674,413, Mar. 22, 1991, abandoned, which is a continuation of Ser. No. 236,693, Aug. 25, 1988, abandoned, which is a continuation-in-part of Ser. No. 887,174, Jun. 30, 1986, abandoned.

[30] Foreign Application Priority Data

Oct. 30, 1984 [CH] Switzerland ..... 5210/84-3
Oct. 8, 1985 [DE] Fed. Rep. of Germany ..... 3535886

[51] Int. Cl.[5] ..... C21D 8/00
[52] U.S. Cl. ..... 148/328; 148/538; 148/654; 148/653
[58] Field of Search ..... 148/328, 332, 538, 653, 654

[56] References Cited

U.S. PATENT DOCUMENTS 4,662,950 5/1987 Abrams ..... 148/12 F
4,671,827 6/1987 Thomas et al. ..... 148/12 E

FOREIGN PATENT DOCUMENTS 52-28425 3/1977 Japan ..... 148/12 F
9919 1/1983 Japan ..... 148/12 F
1083466 9/1967 United Kingdom .

OTHER PUBLICATIONS

Tanaka et al "Three Stages of the Controlled Rolling Process" Micro Alloying 75 1975 pp. 88–99.

*Primary Examiner*—Deborah Yee
*Attorney, Agent, or Firm*—Young & Thompson

[57] ABSTRACT

In a process for producing high-strength, corrosion-resistant and brittle fracture-resistant prestressing steels, there is a fine grain and/or solid solution and/or particle or precipitation hardening, linked with a thermodynamic treatment and subsequent strain hardening. As strengthening measures are used both a solid solution, fine grain and particle or precipitation hardening with a substantially additive effect. The thermomechanical treatment is performed by a controlled rolling of microalloyed, fine grain-melted steels, whilst excluding martensite formation.

22 Claims, 2 Drawing Sheets

PROCESS FOR THE PRODUCTION OF PRESTRESSED STEELS AND ITS NAMED PRODUCT

This is a continuation of co-pending application Ser. No. 07/809,228, filed on Dec. 17, 1991, which is a continuation of application Ser. No. 07/674,413, filed on Mar. 22, 1991, which is a continuation of application Ser. No. 07/236,693, filed Aug. 25, 1988, which is a continuation-in-part of application Ser. No. 06/887,174, filed on Jun. 30, 1986, all cases now abandoned.

The invention relates to a process for the production of high-strength, weldable, more corrosion-resistant and more brittle fracture-resistant prestressing steals.

At present prestressing steels are generally produced from unalloyed, higher carbon-containing high-grade structural steels, namely hot-rolled, stretched or drawn and tempered rods of dimensions 15 to 40 mm, round, with a composition of 0.65 to 0.85 C, 0.65 to 0.85 Si, 1.10 to 1.70 Mn, 0.035 S, 0.035 P and optionally 0.10 to 0.40 V, as well as patented or Stelmor-treated wire rod of dimensions 5.5 to 14. 5 mm, round, with a composition of 0.60 to 0.90 C, 0.10 to 0.30 Si, 0.50 to 0.80 Mn, 0.035 S and 0.035 P and from which cold-drawn bracing or tension wire is produced.

In both cases the raw material used is billet - semi-finished steel of approximately 120 mm 4-kt which, as a function of the manufacturing plant and the available equipment is heat-treated according to different criteria, i.e. brought to the rolling temperature and consequently has different structure and structural characteristics, but in the end product must have the mechanical properties normally required for authorization certificates.

These prestressing steels suffer from the important disadvantage that they are not weldable. Conventional processes are used for the production thereof, such as the known open hearth, electric furnace and basic oxygen steel making processes, the steel being treated neither before nor after. In a few cases steel pretreatment takes place by desulfurization and steel aftertreatment by vacuum. Ingot and continuous casting processes are still used.

Apart from the lack of weldability, said known prestressing steels suffer from deficiencies relating to the mechanical characteristics of corrosion susceptibility and particularly brittle fracture insensitivity in connection with their chemical composition, structural composition and production conditions. A fact which has hitherto been ignored when evaluating prestressing steels is that the brittle fracture susceptibility thereof can begin well above 0° C. and rapidly increases towards lower temperatures. The security against brittle fracture is expressed by the so-called transition temperature to possible brittle fracture. Conventional prestressing steels have a Tu of usually well above 20° C. As most prestressed steel structures, particularly bridges can be subjected to temperatures of up to −40° C. for periods of over several months, this fact must be taken into account when designing and developing prestressing steels. The brittle fracture susceptibility is largely due to the internal degree of purity, oxidic and sulfidic inclusions and inclusion forms and which can now be largely improved by planned steel aftertreatment. The brittle fracture susceptibility and particularly its temperature dependence are closely related with the pearlite (cementite) proportion in the steel, i.e. with the carbon content, which exercises the greatest negative influence. Hitherto there have been no low pearlite, i.e. low carbon prestressing steels.

Corrosion occurs on prestressed steel in numerous different forms, such as pitting, wide pitting, crevice, intercrystalline and transcrystalline corrosion, particular attention having to be paid to stress corrosion cracking. The corrosion-inhibiting properties of copper are known, but copper has not hitherto been used as an alloying constituent in prestressing steels.

Thus, it has not hitherto been possible to produce high-strength steels, which are simultaneously more corrosion-resistant and more brittle fracture resistant, whilst at the same time being suitable for welding. The problem set by the present inventor was to develop such a prestressing steel and simultaneously provide a process for the production thereof.

SUMMARY OF THE INVENTION

It is an object of the present invention to provide an improved method of the production of prestressing steels.

It is another object of the invention to provide a method of producing prestressing steels in which the aforementioned disadvantages of conventional methods of the foregoing type are avoided.

This and other objects of the invention are attained by a process in which a steel comprising

| | | |
|---|---|---|
| 0.04 to 0.20 | weight % | carbon |
| 1.20 to 1.70 | weight % | manganese |
| 0.30 to 0.50 | weight % | silicon |
| 0.035 to 0.06 | weight % | niobium |
| 0.035 to 0.05 | weight % | vanadium |
| 0.30 to 0.50 | weight % | molybdenum |
| 0.30 to 2.00 | weight % | copper |
| 0.04 to 0.06 | weight % | aluminum |
| 0.015 to 0.02 | weight % | nitrogen |
| ≦0.030 | weight % | phosphorus |
| ≦0.020 | weight % | sulphur |

is subjected to a thermomechanical treatment following heating and solidification from the melt, by reheating to a second heat, whereby prior to the thermomechanical treatment, the steel is kept at a very low reheating temperature (=second heat below 1150° C.), and then there is a controlled rolling of the steel with a limited number of passes with a high degree of deformation (10 to 45%) and a high deformation rate to a low deformation temperature just above 850° C. so that the steel is rolled into billets of about 120 mm dia.

A low carbon-content within 0.04 to 0.10 percent by weight, via low pearlite proportion, ensures simultaneously with the present micro-alloying-elements, 0.030 to 0.06 percent by weight niobium, 0.035 to 0.05 percent by weight vanadium, 0.030 to 0.05 percent by weight molybdenum, and due to using the following thermomechanical treatment the highest strengthening effect.

A low carbon-content within 0.04 to 0.10 percent by weight also ensures the weldability of the prestressing steels produced by this process.

Further, the low carbon-content within 0.04 to 0.10 percent by weight ensures an improvement in corrosion-resistance when copper within 0.30 to 2.00 percent by weight is simultaneously used as alloying-element.

The low-carbon-content within 0.04 to 0.20 percent by weight ensures the brittle fracture-security to about −40° C. at least when 1.20 to 1.70 percent by weight of manganese, 0.30 to 0.50 percent by weight of silicon, 0.030 to 0.060 percent by weight of niobium, 0.035 to 0.050 percent by weight of vanadium and 0.03 to 0.05 of molybdenum are simultaneously co-alloyed.

The low carbon-content within 0.04 to 0.10 percent by weight ensures simultaneously with the manganese-content within 1.20 to 1.70 percent by weight the formation of fine grain of at least 12 ASTM E-112.

The low carbon-content within 0.04 to 0.10 percent by weight, via the low pearlite structure, ensures the small ferrite particle size due to using the thermomechanical treatment.

An increased manganese-content within 1.20 to 1.70 percent by weight is alloyed in order to decrease micro-alloying-element-sizes and to increase by this way the effect of precipitation hardening and ensure simultaneously with the present low pearlite structure high- and highest-strength prestressed concrete steel grades.

An increased manganese-content within 1.20 to 1.70 percent by weight ensures by a simultaneous low pearlite content a favorable transition-temperature, respectively brittle-fracture-security and consequently prevents brittle-fracture down to at least −40° C.

Further, an increased manganese-content within 1.20 to 1.70 percent by weight ensures simultaneously with the pearlite structure an optimum of fine grain formation of at least 12 ASTM E-112.

Also, an increased manganese-content within 1.20 to 1.70 percent by weight ensures with the simultaneous presence of 0.035 to 0.060 percent by weight of niobium and 0.035 to 0.050 percent by weight of vanadium in the present case of a low pearlite structure within 0.04 to 0.10 percent by weight of carbon-content the highest strengthening effect.

Furthermore, an increased manganese-content within 1.20 to 1.70 percent by weight with the simultaneous presence of niobium within 0.030 to 0.060 percent by weight and vanadium within 0.035 to 0.050 percent by weight ensures, in case of the present low pearlite structure, the highest strengthening effect and, by this way, the high- and highest-strength prestressed-concrete-steel-grades obtainable by using the following thermomechanical treatment.

The silicon-content within 0.30 to 0.50 percent by weight in presence with presently used micro-alloying-elements, especially niobium within 0.030 to 0.06 percent by weight, vanadium within 0.035 to 0.05 percent by weight and molybdenum within 0.030 to 0.050 percent by weight and a increased manganese-content within 1.20 to 1.70 percent by weight, displace the transition-temperature, respectively the brittle fracture-security towards lower levels, in the present case to at least −40° C. and more.

The niobium-content within 0.030 to 0.060 percent by weight also ensures the highest effect of grain- and precipitation-hardening through the following thermomechanical treatment and, by this way, ensure high- and highest-strength prestressed concrete steel grades.

Furthermore, the niobium content within 0.030 to 0.060 percent by weight ensure, together with the present low pearlite structure and the high manganese-content within 1.20 to 1.70 percent by weight, a very favorable low transition temperature, respectively brittle-fracture-security, in this case at least −40° C. and more.

Also, the niobium-content within 0.030 to 0.060 percent by weight greatly reduces the ferrite grain size and ensure the highest grain-hardening and precipitation-hardening effect by this way and, together with the present manganese-content within 1.20 to 1.70 percent by weight and, due to using the following thermomechanical treatment, ensures high-and highest strength prestressed concrete steel grades.

The vanadium-content within 0.035 to 0.050 percent by weight forms, like niobium, precipitations or deposits of special carbides which ensure fine grain-formation and hardening as well as precipitation-hardening and, by this way and using the following thermomechanical treatment, contribute to ensure high- and highest-strength prestressed concrete steel grades.

The vanadium-content within 0.035 to 0.050 percent by weight together with the increased nitrogen-content within 0.015 to 0.020 percent by weight influences the formation of a fine ferrite particle size and ensure a high additional yield strength by using the following thermomechanical treatment.

A small amount of molybdenum within 0.03 to 0.05 percent by weight ensures, together with the present low pearlite structure, the delay of austenite-recrystallization used by the following thermomechanical treatment to make sure a still lower final rolling temperature just before or through the $\gamma$-$\alpha$ transformation at about 600° to 500° C.

The molybdenum-content within 0.03 to 0.05 percent by weight ensures an even more fine grained structure of at least 12 ASTM E-112 whilst the transition-temperature, and brittle-fracture-security, is simultaneously improved to −40° C. at least.

The molybdenum-content within 0.03 to 0.05 percent by weight ensures the possibility of $\gamma$-$\alpha$ displacement to lower temperatures between 600° to 500° C. and it is also possible to fully utilize the considerable strengthening properties of copper by precipitation-hardening by using the following thermomechanical treatment.

The molybdenum-content within 0.03 to 0.05 percent by weight combined with other micro-alloying elements present in this process, niobium within 0.03 to 0.06 percent by weight and vanadium within 0.035 to 0.050 percent by weight, and simultaneously low pearlite proportions and a high copper-content within 0.30 to 2.00 percent by weight, ensure a high precipitation hardening effect during the precipitation of mixed crystals and during the formation of carbonitrides, particularly at between 650° to 550° C. by using the thermomechanical treatment.

The molybdenum-content within 0.03 to 0.05 percent by weight simultaneously with a high manganese-content within 1.20 to 1.70 percent by weight cause an additional strength increase due to a high dislocation density and fine grain hardening and by particle hardening, in the case of copper alloyed structures with copper content within 0.30 to 2.00 percent by weight and using the following thermomechanical treatment.

The copper-content within 0.30 to 2.00 percent by weight ensures two purposes, namely a strong strengthening effect due to precipitation hardening by using the thermomechanical treatment and a powerful corrosion-inhibiting effect.

The copper-content within 0.3 to 2.0 percent by weight ensure simultaneously the corrosion-inhibiting effect which can be particularly well used in the case of the present high- and highest-strength prestressed concrete steel grades produced with the following thermomechanical treatment, because at the possible low final rolling temperatures between 600° to 500° C., which also lead to the highest strength rises, copper, simultaneously with the presently used precipitation-hardening elements, especially niobium, vanadium and molybdenum, also acts as a very strong precipitation-hardening element between 650° and 550° C. through rapid cooling from the γ-range at approximately 840° C. to 650/550° C.

A high copper-content within 0.3to 2.00 percent by weight in the presence of a niobium-content within 0.03 to 0.06 percent by weight both precipitation hardening mechanisms come into action due to the precipitation of mixed crystals and carbonitrides when there are micro-alloyed structure and simultaneously a low pearlite content.

The copper-content within 0.3 to 2.0 percent by weight is simultaneously alloyed with 1.20 to 1.70 percent by weight of manganese and 0.03 to 0.05 percent by weight of molybdenum, and apart from particle hardening, there can be an additional strength rise through a high dislocation density and a fine grain hardening.

Increased amounts of aluminum within 0.04 to 0.06 percent by weight and nitrogen within 0.015 to 0.02 percent by weight are added within the steel-check-analysis in order to ensure that the micro-alloying-elements, especially niobium and vanadium, can be completely dissolved at the temperature and staying-time at 1150° C. and prevent a redissolving of the micro-alloying-elements.

Before and/or after refining, the steel-melt may be substantially desulfurized below 0.020 percent by weight.

The steel-melt may be subjected to a ladle-treatment after the refining process. The ladle-treatment after the refining-process consists in an inert-gas flushing, a vacuum treatment deoxidation and an inclusion modification with metallic calcium or calcium slags.

The thermomechanical treatment begins by reheating the billets quickly up to 850° C. and then slowly to a temperature at about below 1150° C. observing a staying-time in order to dissolve completely the micro-alloying elements, especially niobium and vanadium.

The staying-time at 1150° C. must ensure that the used micro-alloying-elements, especially niobium and vanadium, are completely dissolved in particle quantities of at least $20\times10^6$ over $mm^2$, said particles having diameters of 10 to 20 nm.

The thermomechanical treatment, after reheating and dissolving the used micro-alloying-elements at a temperature below about 1150° C., comprises a first stage wherein the hot-rolling deformation at a low deformation-temperature above 850° C. is 10 to 45 percent in which rolling takes place in a controlled manner with at least one or several passes with a high degree of deformation and a high speed.

In the first stage the range of conventional grades of prestressed concrete steels are produced, which e.g. according to Euro-Standard 138 have normal (usual) strengths but extended application properties: corrosion-resistant, brittle-fracture-resistant and weldable due to using level one of the thermomechanical treatment.

The thermomechanical treatment comprises a second stage in which an accelerated cooling is effected from about 850° C. to approximately 650/550° C. by quenching with water or, at least, a dilute emulsion without rolling whereby there is a reduction of the γ-α -transformation and a recrystallization delay.

In the second stage the ranges of high-strength grades of prestressed concrete steel are produced, which have high-strength but also extended application properties; they are corrosion-resistant, brittle-fracture-resistant and weldable by using levels I and II of the thermomechanical treatment.

The thermomechanical treatment comprises a third stage in which final rolling takes place in a controlled manner with at least one or several passes with a high degree of deformation between 10 to 45 percent and a high speed from approximately 650/550° C. to a low final rolling temperature just above the $Ar_3$ limit or through the transformation followed by a residence-time and a delayed cooling, together with a speed of approximately 0.25 minutes per mm of section.

Highest-strength grades of prestressed concrete steels with extended application properties are produced in the third stage, these steels are corrosion-resistant, brittle-fracture-resistant and weldable due to using levels I, II and III of the thermomechanical treatment.

During thermomechanical treatment there are both a solid solution, fine grain-, particle-and precipitation-hardening with a substantially additive effect of a strengthening mechanism.

The thermomechanical treatment is a controlled rolled manner of microalloyed, fine-grain melted steels and prevents martensite formation.

The recrystallization of the microalloyed, fine-grain melted steel leads to a very fine austenite grain structure prior to ferrite-pearlite transformation.

The controlled rolling of the microalloyed, fine-grain-melted steel ensures the precipitation of carbides, nitrides and/or carbonitrides, so that there are both a solid solution and also a fine-grain- and a particularly strong particle-hardening.

The temperature is controlled to provide that a γ-α -transformation takes place shortly before and/or during the lowest possible final rolling temperature between 600° and 500° C., which is just before $Ar_3$ or through the γ-α -transformation at said temperature.

An optimum possible particle hardening in the form of carbides, nitrides and/or carbonitrides through precipitation during the thermomechanical treatment, in addition to the fine-grain- and solid-solution-hardening is provided by alloying into the steel such microalloying elements selected from the group consisting of niobium, vanadium and molybdenum and mixtures thereof.

The austenite grain structure is made finer by incorporating in the steel melt during the alloying process in the $O_2$ converter higher amounts of aluminum within 0.04 to 0.06 percent by weight and nitrogen within 0.015 to 0.02 percent by weight which produces during the thermomechanical treatment fine deposits of nitrides, carbides and/or carbonitrides of niobium and vanadium in needed particle quantities of $20\times10^6$ per $mm^2$, said particles must have diameters of 10 to 20 nm.

Portions of non-recrystallized austenite are deformed by a recrystallization delay during the low final rolling temperature between 650° and 500° C. resulting in elongated grain surfaces.

A low austenite recrystallization temperature between 650° and 500° C. is ensured.

The start of grain growth to be prevented during the preheating phase in the thermomechanical treatment is displaced towards an elevated temperature at 1150° C. by using increased amounts of aluminum within 0.04 to 0.06 percent by weight and nitrogen within 0.015 to 0.02 percent by weight.

The obtained product "wire rod" can be treated by strain hardening measures to cold stretched bars or cold drawn wire or to stranded wire.

DETAILED DESCRIPTION OF THE PREFERRED EMBODIMENT

In the process according to the present invention low carbon, normal strength or high strength or highest strength prestressing steels which are corrosion-resistant, brittle-fracture resistant and weldable and in accordance to steel-check analysis containing:

| | | |
|---|---|---|
| 0.04 to 0.20 | percent by weight | carbon |
| 1.20 to 1.70 | percent by weight | manganese |
| 0.30 to 0.50 | percent by weight | silicon |
| 0.035 to 0.06 | percent by weight | niobium |
| 0.035 to 0.05 | percent by weight | vanadium |
| 0.30 to 0.50 | percent by weight | molybdenum |
| 0.30 to 2.00 | percent by weight | copper |
| 0.04 to 0.06 | percent by weight | aluminum |
| 0.015 to 0.02 | percent by weight | nitrogen |
| ≦0.030 | percent by weight | phosphorus |
| ≦0.020 | percent by weight | sulphur |

the balance being incidental impurities are subjected to a thermomechanical treatment after a first heating, cooling and solidification of a ladle-composition of the melt and to rolling into billets of about 120 mm of diameter, the thermomechanical treatment beginning with reheating to a second heating at a temperature below about 1150° C. in a pusher-type furnace.

Figure 1:
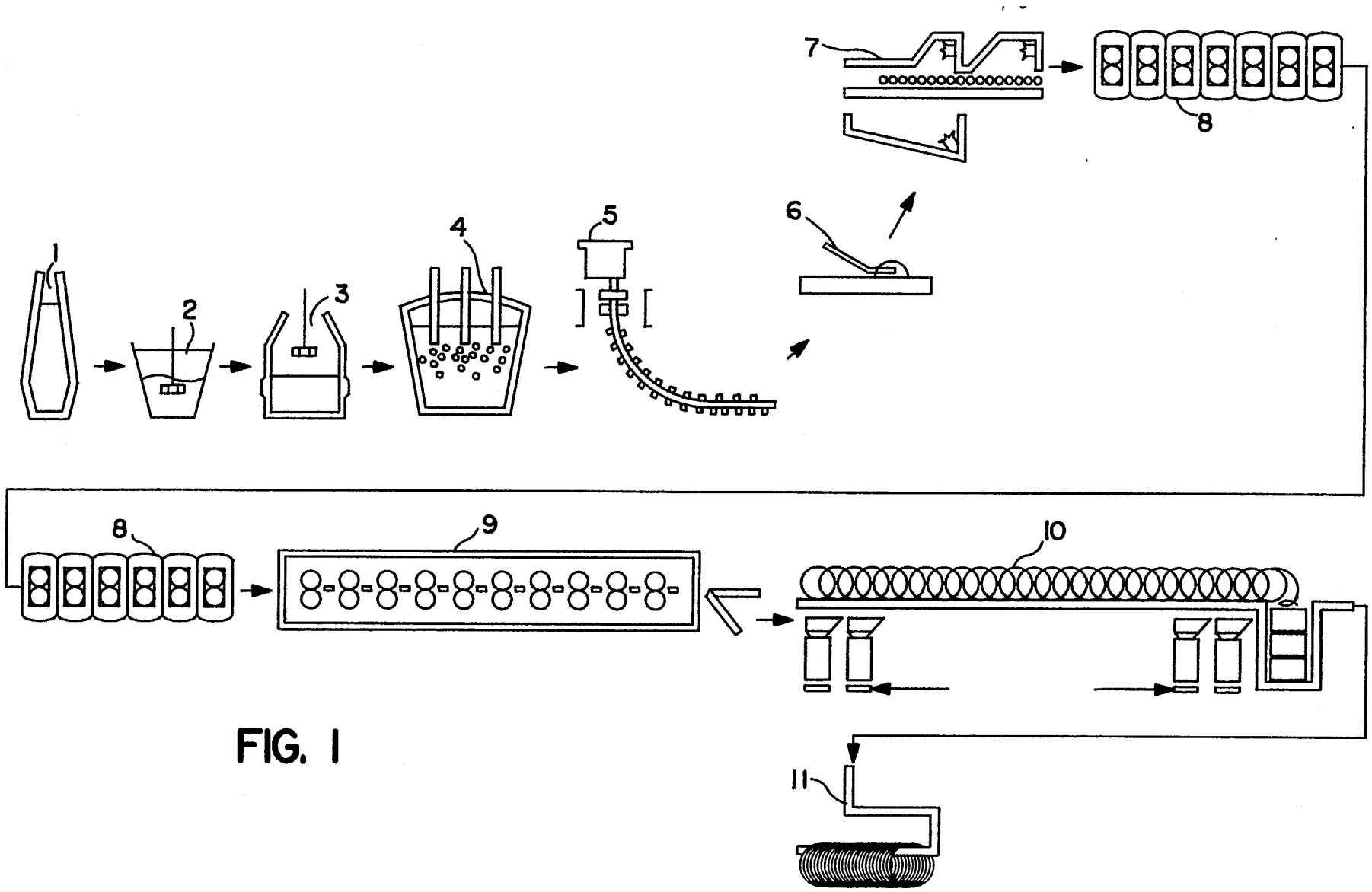
FIG. 1 is a diagrammatic representation of the steel preparing process according to the invention.

As seen in FIG. 1 which schematically shows the process according to the invention the steel composition of the content identified above is supplied from a blast furnace 1 to a ladle 2 for desulfurization and from there into a converter 3 for oxygen blowing. The steel composition is then subjected to ladle treatment in a step 4 (Ca+other components). Step 5 schematically shows a continuous casting of billets which are cooled at a cooling station 6 and are conveyed to a reheating station 7 where they are reheated to 1150° C. in a pusher-type furnace. Steps 8, 9, and 10 show milling or rolling of billets to technical products, e.g. wires.

The reason for keeping the steel at a low reheating temperature is that vanadium and niobium dissolve at 850° or 950° C., but are redissolved at over 1150° C. The latter is to be avoided. A particle size of 100 to 200 Å and a particle quantity of $20\times10^6$ per $mm^2$ are to be obtained for the sought objective.

This is followed by controlled rolling of the steel with a low number of passes and a high degree of deformation (10 to 45%) and a high deformation rate to a low deformation temperature just above 850° C. Due to the copper in the steel, this temperature limit must be respected, because an effective work hardening deposition of copper can only be achieved by accelerated cooling from approximately 850° C. to approximately 650/550° C. without rolling and it is known that at temperatures below 850° C. there is no further copper precipitation during rolling. In the temperature range 850°–650/550° C. a quick cooling (quenching) with water or emulsion must be applied.

By means of this first stage of thermomechanical treatment, it was possible to produce wire rod qualities for the production of cold-drawn wire, three-wire strands, seven-wire strands and tie rods, whose characteristics comply with European Standard 138 but which also have additional use characteristics (more corrosion resistant, brittle fracture resistance and weldable). This avoids, in the case of tie rods, a costly cold straining (stretching) and subsequent tempering, which constitutes an important advantage of the invention.

The actual hardening processes of the presently used strengthening mechanisms mainly occur during the range between 850° C. and a residence time close to the $AR_3$ limit. In a further inventive process stage, there is accelerated cooling without rolling to approximately 650/550° C., so that there is a reduction of the $\gamma$-$\alpha$ transformation, accompanied by a simultaneous recrystallization delay. Residence time and delayed cooling are approximately 0.25 min per mm diameter.

Figure 2:
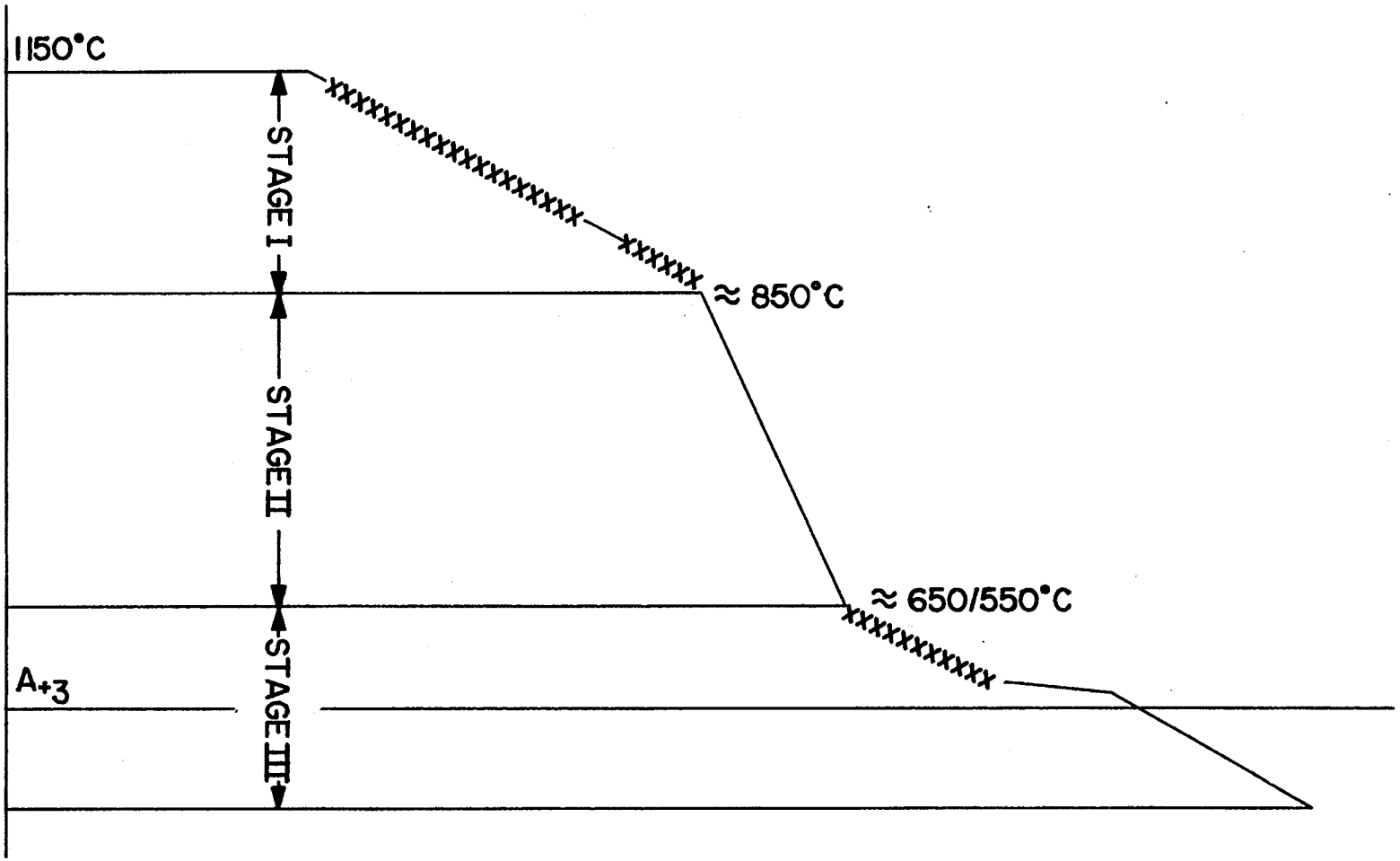
FIG. 2 is a diagrammatic view showing the stages of the process of the invention.

FIGS. 2 serves to illustrate the process sequence. When using stages 1 and 2 of the process of the invention, strength classes of hardened and tempered wire corresponding to European Standard 138 are obtained, without any need for the costly hardening and tempering, which is a further advantage of the present process. In the case of tie rods and wire rod, the yield strength is increased by at least 20% compared with conventional grades, making it possible to also produce cold-drawn wires and from these strands with correspondingly increased strength properties.

According to the invention, a third treatment stage can be provided in which, as from approximately 650/550° C., there is again controlled rolling with one or a few passes, i.e. with a high degree of deformation and speed. Consideration is then given to a residence time and a delayed cooling, e.g. with static air. As a result of increased precipitation hardening, there is a strength rise of at least 40% compared with conventional prestressing steels.

Following the thermomechanical treatment and the strengthening mechanisms linked therewith, there can additionally be a strain hardening of the steel, if higher strength classes are sought or required.

During the thermomechanical treatment according to the present invention, the strength increase mechanisms have an additive effect due to the chemical composition and the planned metering of the microalloying elements. These mechanisms are in particular fine-grain hardening, solid solution hardening and in particular precipitation hardening, in which the alloying element copper participates in a particularly effective manner. This means that the thermomechanical treatment, together with the chemical composition for fine-grain melting and hardening is the most important step for realizing the sought objective, namely producing high-strength, more corrosion-resistant, more brittle fracture-resistant and weldable prestressing steels. The metering of the alloying elements is designed in such a way that not only is there a considerable strength increase, but in particular there is a simultaneous toughness increase, via the fine-grain hardening. The planned metering of the alloying elements also leads to the maximum strengthening via the precipitation hardening. A deposition or precipitation in the ferrite is the most effective for strength increase purposes.

Since as a result of the accelerated cooling and a low final rolling temperature with a simultaneous high degree of deformation and high deformation rate with subsequent residence time following final shaping and delayed cooling, precipitation hardening exercises the greatest strength increase effect, maximum significance must be attributed to this thermomechanical treatment phase because, as a result of the planned metering of the alloying elements, said phase simultaneously leads to the maximum brittle fracture protection, particularly through the interaction of the elements manganese and molybdenum.

The prerequisite for an effective strength increase in the sense of the invention is still fine grain hardening and for the optimum realization thereof a fine grain melting is also required and this simultaneously increases the toughness. The grain size to be reached according to ASTM 112 should be at least 9 and preferably at least 12, to which contributes an increased manganese content of 1.45% on average.

For this purpose a very fine austenite grain structure is sought, because this helps to determine the size of the ferrite grains. For this purpose it is necessary that the microalloying elements provided in the guide analysis and in particular aluminum, nitrogen, niobium and vanadium be incorporated into the austenite structure by fine precipitations to inhibit grain growth and for forming strength-increasing obstacles to the dislocations. A particle size of 100 to 200 Å is most effective and the particle quantity per $mm^2$ is approximately 20. $10^6$.

The fine grain melting should comprise the following stages according to the invention:

1. A steel pretreatment, during which a substantial desulfurization is sought and this e.g. takes place through calcium treatment CAB, e.g. by the TN process.

2. A steel aftertreatment, particularly inert gas scavenging, vacuum treatment, deoxidation, killing and if possible inclusion modification and/or ladle treatment with metallic calcium or calcium halide slags.

Continuous casting should be used, because it is the most economical and also qualitatively the best type of casting, with solidification of the steel melt to the raw material, i.e. billets used for prestressing steel production. To ensure a high quality level required for prestressing steels, for the purpose of preventing nucleus faults, such as central segregation and solidification bridges, together with surface defects, special measures must be taken for preventing such faults and defects, such as e.g. reoxidation protection, submerged casting and electromagnetic stirring.

The exact holding time must be experienced in the industrial application of the process. It depends on the quantity of particles known as $20\times10^6$ per $mm^2$ and from the size of particles, known as 10–20 nm.

The low carbon content of about 0.1% provided by the guide analysis largely prevents the occurrence of the aforementioned faults and simultaneously assists the economic side of continuous casting for the production of prestressing steels, by largely obviating the costly measures, such as those required for conventional high carbon-content prestressing steel types, whilst simultaneously ensuring a high degree of purity, homogeneity and quality.

In order to take account of the first aforementioned partial problem, namely increasing the strength of prestressing steels, consideration must be given to the most important strength limiting factors. These in particular include obstacles to dislocation movements. The structure has a particularly high influence on the strength properties of prestressing steels, because for achieving any type of strength increases, there must be obstacles to dislocation movements. These obstacles can be subdivided as a function of these dimensions into:

zero-dimensional: i.e. punctiform obstacles, such as impurity atoms in the mixed crystal - increase in strength by mixed crystal hardening;

monodimensional: linear obstacles as dislocations - strengthening by cold-working;

bidimensional: flat obstacles as particle limits - strengthening by making the particles or grain finer;

tridimensional: spatial obstacles as deposits or precipitations - strengthening by particle hardening or dispersion hardening.

Mixed crystal or solid solution hardening acts through the nature of the chemical composition, particular significance being attached to the influence of the impurity atoms in the substitution mixed crystals and the interstitially dissolved impurity atoms. There are numerous diagrams and tables in this connection revealing the individual alloying elements and their effects on the yield strength increase. The influence of the different alloying elements can be clarified through the distortion caused by these elements in the lattice. The greater the distortion, the greater the strength increase.

Of the four different strengthening types, greatest significance must be attached to fine grain hardening, because the resulting strengthening mechanism is characterized not only by an increase in the strength, but by a simultaneous increase in the toughness. Moreover, the bidimensional obstacles for migrating dislocations are such strong obstacles that they cannot be overcome by the latter. Dislocation is then made impossible and there is a build-up of numerous dislocations at the grain boundary leading to a significant stress concentration and therefore strength influencing. However, it is precisely the average particle size which influences the lower yield strength limit.

In the case of particle or grain hardening by precipitation, it must be stressed that the greatest strengthening occurs when the particle size and spacing are just sufficiently large for no cutting or intersecting to occur. The precipitation processes for particle hardening are greatly influenced by the degree of supersaturation, the deformation, the transformation and finally the recrystallization, to which particular significance must be subsequently attached in connection with the thermomechanical treatment for strength increase purposes. During the development of high-strength prestressing steels, account must also be taken of the precipitation of carbides, nitrides or carbonitrides by particle hardening. It must also be borne in mind that through the precipitations of special carbides or carbonitrides, a specifically higher hardening action is brought about by the microalloying elements niobium and vanadium than by e.g. copper precipitations. According to the invention, these individual strengthening mechanisms can be combined with one another and with a planned strain hardening. Although their action is additive, their proportions in each case can vary considerably as a function of the given conditions. However, it has been found according to the invention that the basic mechanisms of the individual hardening processes only become optimum through a further and namely the most important treatment stage, i.e. the so-called thermomechanical treatment.

The concept of thermomechanical treatment covers a number of special controlled shaping processes, where a significant part is played by the limiting quantities deformation temperature, degree of deformation, deformation rate, deformation time, final deformation temperature, cooling rate, $\gamma$-$\alpha$ transformation, residence time after deformation and subsequent cooling in connection with the optimum improvement to the properties of the steel. The thermomechanical treatment can influence all the values of the mechanical characteristics, but in particular the strength and toughness properties, together with the transition temperature and therefore the brittle fracture insensitivity.

Within the scope of the invention, the thermomechanical treatment takes place through a specific sequence of controlled rolling of the specifically developed microalloyed and fine grain-melted steel. In particular, a low final rolling temperature, a rapid cooling prior to the final rolling pass and a high final degree of deformation are set, so that the recrystallization leads to a very fine austenite grain structure prior to ferrite - pearlite transformation. In the case of controlled rolling of the inventive steel after guide analysis in the inventive order, for this microalloyed steel is brought about through the rolling process, as well as by the precipitation of carbides, nitrides or carbonitrides, both a solid solution and fine-grain structure and particle hardening. From the alloying and rolling standpoints, the temperature is controlled in such a way that the $\gamma$-$\alpha$ transformation takes place shortly before and/or after the lowest possible final rolling temperature, which is shortly before $Ar_3$ and in all cases martensite formation must be prevented.

It is important in the case of low pearlite microalloyed steels, that the carbides and nitrides of the microalloying elements niobium and vanadium have face-centered cubic lattices, as well as being isomorphous and therefore completely miscible. However, the greatest strength-increasing action through the aforementioned strengthening mechanisms takes effect in the body centered cubic lattice. Account must also be taken of the shape and size of the carbonitride precipitation. In connection with the influencing of the mechanical properties, the particle size and quantity, or the particle spacing, together with the shape and arrangement of the precipitations/deposits and their strength are decisive.

These quantities are influenced by the chemical composition and particularly the temperature - time conditions, under which the precipitations/deposits form. As a function of the temperature the carbonitrides can be precipitated in the austenite, during $\gamma$-$\alpha$ transformation or in the ferrite, the latter being most effective for strength increase purposes. The kinetics, extent and temperature position for the precipitations are dependent not only on the thermodynamic conditions, but on the diffusibility of the alloying elements, the degree of supercooling and the nucleus conditions of the precipitations.

The practical measures which must be used to optimize the proportion of fine grain hardening in conjunction with the thermomechanical treatment necessary for this development are in the case of the alloy according to the invention as follows:

Low, fine grain-maintaining pusher-type furnace temperature, particularly for preventing or limiting the redissolving of carbide, nitride and/or carbonitride precipitations or deposits.

High degree of deformation with few pass sequences.

Low deformation temperature.

Reduction of the $\gamma$-$\alpha$ transformation temperature by accelerated cooling and/or by alloying and/or recrystallization delay.

The optimum, finest grain size is obtained in respect to strength increase and simultaneously the most favorable action on the toughness characteristics and transition temperature.

The proportions of fine grain hardening and precipitation hardening and therefore a considerable proportion of the possible strength increase are determined to a significant extent in the invention by the production conditions, i.e. the thermomechanical treatment. Thus it is necessary to have a high degree and rate of deformation, a fast, controlled cooling before and/or after the final rolling pass and a subsequent delayed cooling matched to the production of thermomechanically treated, cold-strained tie rods or wire rod for the production of cold-drawn tension wires and strands.

The final rolling temperature and degree of deformation, particularly in the final pass are decisive for the attainable mechanical properties. With decreasing final rolling temperature, there is a reduction in the pearlite proportion, so that low carbon, microalloyed structures in the controlled finally rolled state only have a limited and often no pearlite in the structure. As a result, the mechanical properties are further favorably influenced.

With greater reductions per pass and a smaller number of passes, smaller austenite particle sizes are obtained, which via a correspondingly smaller ferrite grain structure lead to more favorable mechanical properties. The rising reductions per pass of 10 to 45% have a particularly favorably influence on a finer ferrite particle size and significantly improve the transition temperature or brittle fracture insensitivity. The reduction per pass and final rolling temperature, as well as possible holding times must be matched to the sought characteristics and dimensions of the end products tie rods (thermomechanically treated, cold-stretched) and wire rod (for producing cold-drawn wires), in order on the one hand to ensure the sought metallurgical action and on the other a rolling-economically performance. Thus, rapid rolling and cooling after final rolling have a decisive influence on the attainable mechanical characteristics. A low temperature has an effect on the ferrite particle size due to the $\gamma$-$\alpha$ transformation displaced towards lower temperatures by the accelerated cooling and the precipitation processes taking place during the subsequent slow cooling are greatly aided.

Recrystallization, $\gamma$-$\alpha$ transformation and the precipitation of microalloying elements are decisive for the structure formation in the prestressing steel. these processes can take place in very rapid succession in a few minutes only and also reciprocally influence one another. For the development of high-strength, more corrosion-resistant and more brittle fracture-resistant prestressing steels, based on the mechanical properties and dimensioning ranges, it is necessary to precisely determine the processes taking place and their association with the structures occurring and to optimize the characteristics caused by them.

The final stage of the process following onto the thermomechanical treatment is a strain hardening, which in particular comprises a stretching or drawing. As a result of this following cold working, which is used for producing all prestressing steels and for which the present steels are particularly suitable, there is once again a considerable strength increase compared with the known prestressing steel grades as a result of the degree of deformation to be used.

A further improvement to the characteristics of the inventive prestressing steels in conjunction with the thermomechanical treatment can be attributed to the alloying in of the microalloying elements. Of the possible microalloying elements, niobium has the most effective influence on the fine grain hardening and precipitation hardening through the thermomechanical treatment, i.e. on the strength increase, and this is followed by vanadium. This also applies to the transition temperature improvement.

By microalloying with niobium and vanadium, accompanied by a small amount of pearlite, there is an increase in the strengthening proportion of the manganese and silicon content with rising amounts.

With the simultaneous presence of vanadium, an increase in the nitrogen content leads to an additional rise in the yield strength. There is also an increase in the tensile strength, so that there is a rise in the yield strength from about 70% to 90%, which is particularly important for prestressing steels.

In the niobium-alloyed steel, there is a much higher fine grain than precipitation hardening proportion and consequently not only a higher yield strength than with titanium or vanadium alloying, but in particular a very favorable low transition temperature. The high ratio of fine grain to precipitation hardening by niobium addition is therefore an important reason why niobium is used in a preferred manner, because niobium simultaneously brings about the greatest transition temperature reduction.

With regard to the improvement to the transition temperature or brittle fracture insensitivity, it must be borne in mind that through the alloying of niobium and vanadium, there is a connection between the yield strength increase and transition temperature improvement, independently of the microalloying elements. For the same yield strength, but different niobium or vanadium contents, substantially the same brittle fracture insensitivity or transition temperature is reached. For contents below approximately 0.5%, manganese and nickel, together with silicon also displace the transition temperature towards lower temperatures.

Finer particles lead to a clear improvement in the toughness, apart from having a strengthening effect and this leads to a considerable reduction in the transition temperature. The sought influence is also intensified by a decreasing pearlite proportion. Low pearlite steels are therefore generally particularly insensitive to brittle fracture in the case of a fine ferrite grain.

Particular attention must be paid to the chemical composition of prestressing steels with respect to their cold straining characteristics. The sulphur content is decisive for the anisotropy of the toughness, the most important limiting factor for the cold shapeability. A sought low sulphur content, i.e. a reduced number of sulfide inclusions greatly improves the toughness with respect to fracture reduction, which is very important for prestressing steels. The reduction to the sulfide length is also particularly effective for a more favorable fracture reduction. A strong desulfurization can be achieved by the calcium addition which normally takes place in ladle metallurgy, particular significance being attached to the high vapor pressure of calcium, which at a melt temperature of 1600° C. is 1.86 bar, together with its high oxygen affinity, i.e. measures must be taken to prevent the evaporation of the calcium. Even at sulphur contents of 0.008%, it is no longer possible to detect any manganese sulfides in aluminum-killed steels and instead there are spherical inclusions of calcium and aluminum oxides, containing on their surface small amounts of dissolved sulphur. As a result of the favorable conditions of calcium aluminates with respect to a precipitation from the melt, there is an additional improvement to the oxidic degree of purity. The attainable mechanical properties with calcium treatment have clearly reduced spatial anisotropy of the toughness characteristics. The fracture reduction which is so important for ensuring quality values in prestressing steel is significantly improved by the calcium treatment and with decreasing sulphur content. Desulfurization should take place to below 0.020 weight %.

With respect to the most suitable combined used of microalloying elements, the best properties are obtained through molybdenum - niobium-alloyed structures. An additional improvement in the characteristics is achieved through the combination of niobium-vanadium-molybdenum-copper accompanied by the inventive thermomechanical treatment, the best results being obtained through the use of a low final rolling temperature and a high final deformation degree.

Apart from the consequences of the thermal treatment, the rolling and cooling rate, together with the cooling in the bed have an action in connection with the production of prestressing steels. Down to 750° C. both strength and toughness improvements are established. The effectiveness of the measures responsible for the strength increase is considerably improved by alloying in molybdenum and by regulating the rolling speed with the aim of a maximum reduction of the $\gamma$-$\alpha$ transformation in the range between 650° and 550° C., i.e. a range in which the strength-increasing mechanisms, particularly due to precipitation hardening are most effective.

The most effective means for obtaining optimum mechanical properties are represented by the production of very fine grains, which leads to an increase in the yield strength and simultaneously to an improvement in the transition temperature. In practice, a very fine austenire grain size is sought, because this helps to determine the size of the ferrite grains. As a general empirical value a decrease in the austenite grain size acts with a factor of approximately 0.3 on the reduction of the ferrite grain size. The vital process in the austenite grain growth is not the dissolving of precipitations or deposits, but their caking to large and therefore effective particles.

A measure for controlling the austenite grain size is the incorporation of fine deposits in the austenite structure, so that the grain or particle growth is inhibited. Apart from aluminum, which produces this effect via aluminum nitride, it is in particular the microalloying elements niobium, vanadium and titanium in particle sizes of 100 to 200 Å which act comparably via their carbides, nitrides or carbonitrides. The most favorable conditions for preventing strong grain growth a rise when reheating in the pusher-type furnace for rolling purposes using higher aluminum contents (up to 0.050%) and nitrogen contents (up to 0.020T). With a rising niobium content, there is also a displacement towards higher temperatures of the start of the sudden grain growth.

A further measure for preventing or limiting the redissolving of such deposits when heating prior to rolling is a very low pusher-type furnace temperature. The austenite grain size can also be reduced by higher degrees of deformation. The most marked grain size reduction action occurs at low final deformation temperatures.

If as a result of accelerated cooling, the transformation is displaced towards lower temperatures, then the lower conversion temperature leads to a higher nucleation frequency and a lower grain boundary mobility, which leads to a reduction in the ferrite grain size.

In addition to reducing the grain size, it is possible to delay the recrystallization of the austenite. Non-recrystallized austenite portions are then deformed during the final rolling temperature, so that elongated grains and therefore significantly increased austenite grain surfaces are obtained. Due to the transformation of this structure in the ferrite-pearlite stage, there is a considerable grain size reduction due to the increased density of nuclei and the inhibited growth of the grains formed from these nuclei.

The delay of austenite recrystallization can, apart from the cooling rate control, be favorably influenced by the alloying in of small amounts of molybdenum to the microalloyed, low pearlite structure, so that the $\gamma$-$\alpha$ transformation is displaced towards lower temperatures. This possibility is utilized in the thermomechanical treatment, so that an even finer grain structure is obtained, accompanied by an additional improvement in the transition temperature.

The greater particle size reduction explains why the favorable transition temperature remains unchanged or is even improved in the case of niobium and vanadium or niobium plus vanadium-alloyed structures. Apart from strengthening, the particle size reduction also leads to a toughness improvement as sought by the present invention and this simultaneously leads to a great reduction in the transition temperature. This is assisted by a decreasing pearlite proportion. Low pearlite structures are therefore generally particularly insensitive to brittle fracture in the case of fine ferrite grains.

In the connection between the microalloying constituents and the fine grain hardening, it must be borne in mind that incoherent niobium, vanadium and titanium carbonitrides in effective particle sizes and quantities act in different ways on the ferrite particle size. In the thermomechanically treated state, vanadium only leads to a slight particle size reduction. The basic composition plays a part in that higher carbon and nitrogen contents bring about a finer secondary structure via a stronger or faster precipitation before or during $\gamma$-$\alpha$ transformation. It is pointed out that the optimum particle size reduction occurs with niobium contents between 0.04 and 0.10%, whereas those of titanium and vanadium become increasingly effective with increasing contents.

The carbon and nitrogen content of the steel influences ferrite grain size in steels with niobium to a much lesser extent than in those with vanadium. In the case of decreasing carbon contents, the influence of nucleation through precipitated particles on the particle size decreases in favor of a very marked and in the present case desired recrystallization inhibition by dissolved niobium. Therefore, in the thermomechanically treated state, low pearlite steels have smaller ferrite particle sizes than steels with a high carbon content.

By means of a delay to the presently desired austenite conversion, dissolved vanadium, niobium or titanium lead to a further fine grain action. Rising manganese contents also reduce the transformation temperature, ensure an optimum precipitation of particles and therefore an optimum action of particle hardening.

In connection with the time-displayed austenite conversion, there is generally a recrystallization delay, i.e. recrystallization takes place at lower temperatures, which meets the requirements of reducing $\gamma$-$\alpha$ transformation, recrystallization delay and therefore the setting of a low final rolling temperature and simultaneously permits the optimum precipitation, e.g. of copper and in conjunction therewith there is a maximum strength increase. Due to increased density of the nuclei and growth inhibition of the newly formed ferrite grains, the structure is made much finer.

In connection with precipitation hardening, it must be borne in mind relative to the thermomechanical treatment that the precipitation hardening maximum occurs in the temperature range between 550° and 650° C. this can be clarified by the section of the chemically non-detectable, coherent precipitations or deposits (clusters) of niobium, carbon and nitrogen atoms (also titanium), which precede the incoherent deposits. On reaching the precipitation maximum, attention must be paid to the yield strength drop, brought about by rising temperatures or exceeding the holding time and is caused by the decrease in the coherent tensions on passing from coherent particles and the following increase in the particle diameter and quantity.

The starting material (crude steel) for performing the inventive process is to be a steel, whose guide analysis has the following elements:

| | | |
|---|---|---|
| Carbon | 0.04 to 0.20 | percent by weight |
| Manganese | 1.20 to 1.70 | percent by weight |
| Silicon | 0.30 to 0.50 | percent by weight |
| Niobium | 0.035 to 0.06 | percent by weight |
| Vanadium | 0.035 to 0.05 | percent by weight |
| Molybdenum | 0.30 to 0.50 | percent by weight |
| Copper | 0.30 to 2.00 | percent by weight |
| Aluminum | 0.04 to 0.06 | percent by weight |
| Nitrogen | 0.015 to 0.02 | percent by weight |
| Phosphorus | ≦0.030 | percent by weight |
| Sulphur | ≦0.020 | percent by weight |

The following comments are made on the individual elements:

Via cementite (pearlite), the carbon content leads to a considerable strengthening and in this connection plays an important part. Since, however, the carbon content, via the pearlite proportion, exercises the most significant negative influence on the brittle fracture security (transition temperature) and the weldability, this increasing with the rising pearlite proportion, the carbon content must be reduced to proportions which permit both a strength increase and an improvement to the corrosion resistance, whilst also making it possible to improve the brittle fracture security of about −40° C. and the weldability. With respect to the sought optimum fine grain formation, it must also be borne in mind that the carbon content significantly influences it. With decreasing carbon content, there is a drop in the influence of nucleation by precipitated particles on the particle size in favor of a very marked and in this case desired recrystallization inhibition by dissolved niobium. Low pearlite structures in the thermomechanically treated state have smaller ferrite particle sizes than structures with a higher carbon content.

Manganese in particular decreases the particle size and also through solid solution strengthening and increased precipitation hardening, so that the manganese content is preferably fixed at the upper limit, because the strength increase by manganese is highly dependent on the pearlite content and an appropriately low pearlite proportion also ensures a favorable transition temperature and consequently prevents brittle fracture. Rising manganese contents greatly contribute to delaying the presently desired austenite conversion and consequently bring about an optimum fine grain formation.

With the simultaneous presence of niobium and vanadium as microalloying elements, in the case of a low pearlite structure, the strengthening effect of manganese increases with its content.

What has been said for manganese also applies to silicon. With a silicon content below approximately 0.5%, the transition temperature is displaced towards lower levels. However, even above 0.5%, silicon has a strengthening action but at the same time a highly embrittling effect, which must be avoided for prestressing steels.

Niobium has the most effective influence on the fine grain hardening and precipitation hardening through thermomechanical treatment, i.e. on the attainable strength increase and this is then followed by titanium and vanadium. It leads to the greatest transition temperature drop. The niobium-containing structure leads to a much higher proportion of fine grain hardening than precipitation hardening and consequently not only is there a higher yield strength than with titanium or vanadium-alloyed structures, but in particular there is a very favorable, low transition temperature. Niobium greatly reduces the ferrite grain size. The high ratio of fine grain hardening to precipitation hardening in the structure when niobium is added is consequently an important reason for preferring niobium. Even with a simultaneous low pearlite content, niobium brings about the additional strengthening effect of rising manganese contents.

Like niobium, vanadium forms precipitations or deposits of special carbides, which on the one hand contribute to fine grain formation and hardening and on the other to precipitation hardening and therefore significantly to the strength increase. Like niobium, vanadium contributes to controlling the austenite grain size by the incorporation of fine deposits in the austenite structure, so that grain growth is inhibited. Like niobium, vanadium also contributes to the solid solution strengthening, but both are insoluble in the ferrite. Thus, their precipitation in the ferrite is most effective for a strength increase. The carbides and nitrides of vanadium and niobium have a face-centered cubic lattice, are amorphous and therefore completely miscible. Unlike titanium, they do not contribute to sulfide formation. In the case of an increased nitrogen content, vanadium influences the formation of a fine ferrite particle size to the greatest extent and leads to an additional yield strength increase. Like niobium, dissolved vanadium influences this fine grain action and hardening, via a delay to austenite conversion.

The delay to austenite recrystallization is aided by the alloying in of small amounts of molybdenum to the microalloyed, low-pearlite structures, so that the $\gamma$-$\alpha$ transformation is displaced towards lower temperatures. This possibility is utilized during the thermomechanical treatment by a still lower final rolling temperature so that an even more fine-grained structure is obtained, whilst the transition temperature is simultaneously improved. By alloying in molybdenum and the resulting possibility of $\gamma$-$\alpha$ displacement to lower temperatures, it is also possible to fully utilize the considerable strengthening properties of copper. In the case of microalloyed structures of the presently described type and simultaneously low pearlite proportions and a high copper content, both precipitation hardening mechanisms act during the precipitation of mixed crystals and during the formation of carbonitrides, particularly at between 650° and 550° C.

With high manganese and molybdenum contents, such as here for high-strength prestressing steels, an additional strength increase can be achieved through a high dislocation density and fine grain hardening, apart from by particle hardening, in the case of copper-alloyed structures.

Due to its two advantages, copper is used for the present purpose namely due to its strong strengthening action due to precipitation hardening and due to its powerful corrosion-inhibiting action. The corrosion-inhibiting action of copper can be particularly well used in the case of high strength structures produced with thermomechanical treatment, because at the low final rolling temperatures, which also lead to the highest strength rises, copper simultaneously with the presently used precipitation hardening elements, also acts as a precipitation hardening element between 650° and 550° C. Through rapid cooling from the $\gamma$-range at approximately 840° C., in the case of low pearlite structures and the thermomechanical treatment provided here, approximately 2% of copper can be dissolved. This leads to the precipitation of a copper-rich, face-centered cubic mixed crystal in the form of incoherent, spherical particles which, as from a given particle size, leads to a considerable precipitation hardness effect as a result of looping. In the presence of niobium, both precipitation hardening mechanisms come into action due to the precipitation of mixed crystals and carbonitrides when there are microalloyed structures and simultaneously a low pearlite proportion and a high copper content. With high copper contents, the copper-alloyed structures must be given a nickel content of up to 1%, in order to prevent the solder embrittlement caused by copper. In the case of the present high manganese and molybdenum contents, in the case of copper-alloyed structures, apart from by particle hardening, there can be an additional strength rise through a high dislocation density and a fine grain hardening. The corrosion-inhibiting action of copper is very effective at the low copper content of 0.25 to 0.40%. Therefore the copper content must be matched in order on the one hand to be able to use in an optimum manner the corrosion-inhibiting action and the strengthening mechanisms, whilst on the other ensuring that the unacceptable solder embrittlement for prestressing steels does not occur and if possible avoiding the addition of nickel for preventing this.

As a result of the aluminum content, the sudden grain growth on heating the raw material is raised to approximately 1150° C., the holding time also being significant. Apart from aluminum, which produces this effect via aluminum nitride, it is in particular the microalloying elements niobium and vanadium which, via their carbides, nitrides or carbonitrides, have a comparable action. For preventing or limiting the redissolving of such precipitations or deposits on heating prior to rolling, it is important to have a low pusher furnace temperature. The most favorable relationships for preventing the strong grain growth rise on reheating for rolling purposes are provided by higher aluminum contents. Aluminum also contributes to solid solution solidification.

Apart from aluminum, the sudden grain growth prior too heating for rolling purposes is also raised to higher temperatures of approximately 1150° C. by nitrogen. By increasing the nitride content, an increased nitrogen content also greatly contributes to increasing strength. Particularly when vanadium is present, there is a marked rise in the yield strength. It also leads to an increase in the tensile strength, so that for prestressing steels there is a particularly important rise in the yield point from 70 to 90%.

In the present case, the phosphorus content must be limited, although a higher content would raise the yield point, but would simultaneously greatly embrittle the steel. A combined oxygen blowing/inert gas scavenging makes it possible to reduce the phosphorus content and largely prevent its embrittling action. A corresponding phosphorus content reduction is also made possible by ladle metallurgy.

According to the invention, the lowest possible phosphorus content is of particular significance and must therefore be sought.

The sulphur content plays the most decisive part in connection with the anisotropy of the toughness, the most important limiting factor for the cold workability of prestressing steels.

A lower sulphur content, i.e. a reduced number of sulfide inclusions, significantly improves the toughness with respect to fracture reduction, which is very important for prestressing steels. The reduction of the sulfide length is also very effective for a favorable fracture reduction. Significant desulfurization can be obtained through the calcium additions normal in ladle metallurgy.

With regard to titanium, which is not involved in the invention, it is pointed out that, unlike niobium and vanadium, it participates in sulfide formation and initially also binds the complete nitrogen to nitrides, TiN and subsequently the sulphur to a titanium carbosulphide $Ti_4C_2S_2$. Therefore, for both reasons no account is taken of titanium, because inter alia the action of the austenite grain growth and that of a strength increase in conjunction with other microalloying elements would be removed by an increased nitrogen content.

In the case of the inventive production of high-strength, more corrosion-resistant and more brittle fracture-resistant prestressing steels, it is possible to remove all those problems which had to be taken into consideration during the production of conventional high carbon content prestressing steel grades. In particular, it is possible to obviate the important objections to production by continuous casting and caused mainly by the central segregations and surface faults which may impair drawability. The economic advantages of continuous casting compared with ingot casting then come fully to bear both as regards costs and quality. It is possible to eliminate the hitherto possible enrichment of carbon in the center of the casting, which leads to eutectoid deposits of cementite lattices and therefore to a considerable deterioration not only of the structure and therefore the characteristics, but also the resistance to brittle fracture.

Thus, there is also an elimination of the measures which had to be taken due to the high oxygen affinity of the carbon during production, both during melting (e.g. in build-up or remelting processes), oxidation and the subsequent steel after treatment, particularly an expensive reoxidation protection. the obtaining of a high microscopic degree of purity and a substantial avoidance of oxidic and sulfidic inclusions are aided. In connection with continuous casting, it is possible to largely eliminate the high expenditure which had to be provided for electromagnetic stirring in the production of high carbon-containing wire grades, thereby preventing the highly disadvantageous central segregations, solidification bridges, oriented solidification structures, internal and surface faults.

The prestressing steels produced according to the invention have much higher strength values, considerably reduced internal stresses, greatly increased resistance to brittle fracture, much higher wear resistances, greatly improved use possibilities due to their suitability for welding and much better corrosion resistance.

With respect to the two latter advantages, it is also pointed out that with regards to improving the corrosion resistance, the present invention makes it possible to consider more economical elements acting in much the same way as chromium in stainless steels. In addition, such corrosion-inhibiting elements can be particularly well used in high-strength steels produced with thermomechanical treatment, because at the low final rolling temperatures, which simultaneously bring about the highest strength rises, in addition to the corrosion-inhibiting action through precipitation hardening, they contribute to the strength rise. However if it is also possible to obtain suitability for welding, apart from a strength increase in the high-strength prestressing steels, this leads to significant possibilities regarding the constructional simplification and improvement of the presently conventional tension or clamping systems. As is known e.g. in bridge building; the coupling members constitute the most sensitive weak points for the occurrence of damage as a result of the penetration of corrosion-aiding media to the steel. In accordance with the present technical possibilities, such coupling members are generally placed too close together. The resulting high number of coupling joint leads to a simultaneously high number of weak points.

When using the inventive high-strength, more corrosion-resistant and more brittle fracture-resistant prestressing steels, it is possible to produce longer tension castings, thereby reducing the number of coupling members and therefore weak points. If, as a result of the suitability for welding of these prestressing steels, the clamping systems are also constructionally simplified and improved, this also leads to a great reduction of the susceptibility to damage.

Further advantages are reduced and therefore more easily controlled diameters of tension wires, tie rods or strands; the construction of smaller concrete thicknesses due to the higher strength properties, so that constructional weight is saved and much greater possibilities are provided with respect to the constructional design, leading to constructions which could not be realized with conventional prestressing steel of lower strength for technical or economic reasons, accompanied by a reduction in the total load of the moving structures (bridge building, member builder) and reduction of transportation costs for the moving structures and prestressing steel.

Despite the use of microalloying elements and improved steel aftertreatment for increasing the strength, increase in the corrosion resistance and brittle fracture resistance, the present price level of prestressing steels can be maintained or even improved, due to the considerable advantages during production and use. As a result of the additional constructional possibilities resulting from the suitability for welding in clamping systems, the economic aspects are greatly improved. However, overall the economic advantages would even override the disadvantage of a price rise.

What is claimed is:

1. A process for the production of low carbon, high strength, weldable corrosion-resistant, brittle-fracture-resistant prestressing steel comprising the steps of heating a steel composition containing:

| | | |
|---|---|---|
| 0.04 to 0.20 | percent by weight | carbon |
| 1.20 to 1.70 | percent by weight | manganese |
| 0.30 to 0.50 | percent by weight | silicon |
| 0.035 to 0.06 | percent by weight | niobium |
| 0.035 to 0.05 | percent by weight | vanadium |
| 0.30 to 0.50 | percent by weight | molybdenum |
| 0.30 to 2.00 | percent by weight | copper |
| 0.04 to 0.06 | percent by weight | aluminum |
| 0.015 to 0.02 | percent by weight | nitrogen |
| ≦0.030 | percent by weight | phosphorus |
| ≦0.020 | percent by weight | sulphur |

the balance being iron and incidental impurities to melt the composition, thereafter cooling said melted composition to form a solidified ladle-composition and thermomechanically treating said solidified ladle-composition by reheating at a temperature below about 1150° C. in a pusher-type furnace, and then rolling said reheated steel into billets of about 120 mm in diameter;

wherein the thermomechanical treatment comprises a stage in which accelerated cooling is effected without rolling to approximately 650° to 550° C. whereby there is a reduction of the $\sigma$-$\alpha$ transformation and a recrystallization delay; and wherein the thermomechanical treatment comprises another stage in which rolling takes place in a controlled manner with at least one with a high degree of deformation and at a high speed from approximately 650° to 550° C. to a low final rolling temperature just above the $Ar_3$ limit, followed by a residence time and delayed cooling of approximately 0.25 minutes per mm diameter.

2. A process for the production of low carbon, high strength, weldable corrosion-resistant, brittle-fracture-resistant prestressing steel comprising the steps of heating a steel composition containing:

| | | |
|---|---|---|
| 0.04 to 0.20 | percent by weight | carbon |
| 1.20 to 1.70 | percent by weight | manganese |
| 0.30 to 0.50 | percent by weight | silicon |
| 0.035 to 0.06 | percent by weight | niobium |
| 0.035 to 0.05 | percent by weight | vanadium |
| 0.30 to 0.50 | percent by weight | molybdenum |
| 0.30 to 2.00 | percent by weight | copper |
| 0.04 to 0.06 | percent by weight | aluminum |
| 0.015 to 0.02 | percent by weight | nitrogen |
| ≦0.030 | percent by weight | phosphorus |
| ≦0.020 | percent by weight | sulphur |

the balance being iron and incidental impurities to melt the composition, thereafter cooling said melted composition to form a solidified ladle-composition and thermomechanically treating said solidified ladle composition by reheating at a temperature below about 1150° C. in a pusher-type furnace, and then rolling said reheated steel into billets of about 120 mm in diameter;

wherein the thermomechanical treatment begins by reheating the steel quickly up to 850° C. and then slowly to a temperature at about below 1150° C. observing a staying time in order to dissolve completely micro-alloying elements selected from the group consisting of niobium and vanadium used in the composition;

wherein the thermomechanical treatment, after reheating and dissolving the micro-alloying elements at a temperature below about 1150° C., comprises a first stage wherein a hot-rolling deformation at a low deformation-temperature above 850° C. is 10 to 45 percent in which rolling takes place in a controlled manner with at least one or several passes with a high degree of deformation and a high speed.

3. A process according to claim 1, wherein the degree of deformation is 10–45%.

4. A process according to claim 1, including strain hardening the steel following the thermomechanical treatment.

5. A process according to claim 4, wherein the steel is substantially desulfurized below 0.020 percent by weight.

6. A process according to claim 4, including desulfurizing the steel.

7. A process according to claim 4, including subjecting the steel melt is subjected to flushing by gas, a vacuum treatment deoxidation and an inclusion with metallic calcium or calcium slags.

8. A process according to claim 2, wherein the staying time at 1150° C. is such to ensure that the used micro-alloying elements are substantially dissolved, have a density of at least $20\times10^6$ per $mm^2$, and have a particle size with a diameter of 10 to 20 nm.

9. A process according to claim 2, wherein the thermomechanical treatment comprises a second stage in which an accelerated cooling is effected from about 850° C. to approximately 650° to 550° C. by quenching with water or a dilute emulsion without rolling whereby there is a reduction of the $\gamma$-$\alpha$ -transformation and a recrystallization delay.

10. A process according to claim 9, wherein the thermomechanical treatment comprises a third stage in which final rolling takes place in a controlled manner with at least one or several passes with a high degree of deformation between 10 to 45 percent and a high speed from approximately 650° to 550° C. to a low final rolling temperature just above the $Ar_3$ limit or through the transformation followed by a residence-time and a delayed cooling of approximately 0.25 minutes per mm of section.

11. A process according to claim 10, wherein the temperature is controlled to provide that a $\gamma$-$\alpha$ -transformation takes place shortly before and during the lowest possible final rolling temperature between 600° and 500° C., which is just before $Ar_3$ or through the $\gamma$-$\alpha$ transformation at said temperature.

12. A process according to claim 10, comprising the steps of alloying the steel melt in an $O_2$ converter before a ladle treatment whereby an austenite grain of the steel is made finer by incorporating in the steel melt during the alloying in the $O_2$ converter amounts of aluminum within 0.04 to 0.06 percent by weight and nitrogen within 0.015 to 0.02 percent by weight which produces during the thermomechanical treatment fine deposits of nitrides, carbides and/or carbonitrides of niobium and vanadium in needed particle quantities of $20\times10^6$ per $mm^2$, said particles being of diameters of 10 to 20 nm.

13. A process according to claim 10, wherein the steel contains portions of non-recrystallized austenite, which non-recrystallized austenite portions are deformed during the low final rolling temperature between 650° and 500° C. resulting in elongated grain surfaces.

14. A process according to claim 10, wherein the steel melted composition is subjected to aftertreatment selected from the group consisting of inert gas scavenging, vacuum treatment, oxidation, inclusion modification and ladle treatment with metallic calcium of calcium halide slags.

15. A process according to claim 10, wherein a recrystallization of said fine grain-melted steel takes place during said thermomechanical treatment, which leads to a very fine austenite grain prior to ferrite-pearlite transformation.

16. A process according to claim 15, wherein the rolling process employed on said fine grain-melted steel is supplemented by the precipitation of carbides, nitrides, and carbonitrides, so that there are a solid solution and a fine grain and a particularly marked particle hardening.

17. A process according to claim 16, wherein following the thermomechanical treatment the steel is subjected to strain hardening measures selected from the group consisting of stretching and drawing.

18. A process according to claim 17, wherein the steel composition also further contains fine deposits selected from the group consisting of aluminum nitrides, and the carbides, nitrides and carbonitrides of niobium and vanadium in particle quantities of $20\times10^6$ per $mm^2$, said particles having diameters of 100 to 200 Å while using the maximum degrees of deformation and speeds, together with the lowest final rolling temperature.

19. A process according to claim 18, wherein portions of non-recrystallized austenite are deformed during the low final rolling temperature resulting in elongated grain surfaces.

20. A process according to claim 19, wherein the steel composition further contains increased amounts of aluminum and nitrogen are added at a particle size of 100 to 200 A.

21. A process according to claim 2, wherein the thermomechanical treatment comprises a second stage in which an accelerated cooling is effected from about 850° C. to approximately 650° to 550° C. by quenching with water or a dilute emulsion without rolling whereby there is a reduction of the $\gamma$-$\alpha$ -transformation and a recrystallization delay.

22. A process according to claim 21, wherein the thermomechanical treatment comprises a third stage in which final rolling takes place in a controlled manner with at least one or several passes with a high degree of deformation between 10 to 45 percent and a high speed from approximately 650° to 550° C. to a low final rolling temperature just above the $Ar_3$ limit or through the transformation followed by a residence-time and a delayed cooling of approximately 0.25 minutes per mm of section.

* * * * *